United States Patent [19]

Layer et al.

[11] Patent Number: 4,784,270

[45] Date of Patent: Nov. 15, 1988

[54] CORNER POST FOR SHIPPING CONTAINER

[75] Inventors: Eddie Layer; Bobby Whitworth, both of Louisville, Ky.

[73] Assignee: Boise Cascade Corporation, Boise, Id.

[21] Appl. No.: 43,339

[22] Filed: Apr. 28, 1987

[51] Int. Cl.[4] ..... B65D 81/04

[52] U.S. Cl. ..... 206/586; 206/320; 229/DIG. 1

[58] Field of Search ..... 206/586, 320, 453; 229/DIG. 1

[56] References Cited

U.S. PATENT DOCUMENTS

| | | | |
|---|---|---|---|
| 1,821,692 | 9/1931 | Copeland | 206/586 |
| 3,126,144 | 3/1964 | McCulloch | 206/586 X |
| 3,734,389 | 5/1973 | Brown | 229/DIG. 1 |
| 3,957,196 | 5/1976 | Kellerman | 206/586 X |
| 3,982,682 | 9/1976 | Fremion | 206/586 X |

FOREIGN PATENT DOCUMENTS

| | | | |
|---|---|---|---|
| 3303180 | 8/1984 | Fed. Rep. of Germany | 206/586 |
| 52788 | 4/1977 | Japan | 206/586 |

*Primary Examiner*—Jimmy G. Foster

*Attorney, Agent, or Firm*—Rogers, Howell, Moore & Haferkamp

[57] ABSTRACT

A corrugated paperboard corner post as utilized for packaging in a shipping container is formed by folding over a portion of corrugated, the upper and lower portions of the corrugated being divided into three panels each by slit score lines extending the length of the corner post, and gluing the outer panels of the upper and lower portions together. The corner post is initially formed in a flattened configuration to facilitate its shipment and handling in bulk and may be quickly and easily re-configured into its operable orientation by pushing both edges together and causing the panels to fold about their score lines.

15 Claims, 1 Drawing Sheet

CORNER POST FOR SHIPPING CONTAINER

BACKGROUND AND SUMMARY OF THE INVENTION

Corrugated paperboard containers and packaging materials have been used for some time to box all kinds of products for shipment. In some of these corrugated paperboard containers, corner posts are utilized to firmly position an item within the container and maintain it in a spaced relationship from the sidewall of the container such that a foreign object would have to enter a substantial distance into the container before contacting the item to thereby damage it in some way. Corner posts are generally comprised of four folded up pieces of corrugated paperboard which are inserted in the corners of the shipping container and friction fit between the product and the container sidewall. This packaging technique is especially useful in boxing consumer goods such as dishwashers and the like where a painted surface must be protected from damage to preserve the appearance of the item. Furthermore, these corner posts serve to fix the item in position with a minimal amount of contact against the item's surface. With this minimal contact, damage to the item's surface through rubbing or shifting of the item during shipment is minimized. Still another advantage of corner posts is that when they are sized to extend the full height of the container, they can significantly add to the compressive strength of the container to thereby permit more containers to be stacked atop each other during storage and shipment.

Because of the many advantages of corner posts, and their relatively inexpensive nature, corner post packaging made from corrugated paperboard has proliferated in application. However, one of the few drawbacks with a corner post packaging arrangement is the labor intensive nature of the prior art designs. Typical prior art designs for a corner post comprise a flat sheet of corrugated paperboard which has a number of regular score lines or slit score lines to divide the sheet into a series of panels. For ease in shipment and handling, the corner posts are manufactured in a flat configuration. For usage, it is then necessary for a shipping clerk to grasp the corner post "flat", bend the corner post about its score lines to roll it up into shape, and hold the corner post in its operable configuration as it is inserted between the container sidewall and the item being boxed therein. As the "flats" are rolled up into the corner post configuration, some attention and effort must be given to holding the corner post in its proper configuration or the corner post has a distinct tendency to unroll. Typically, with prior art corner post designs, there is no structure provided in the corner post to help hold it in its operable configuration and instead the shipping clerk is relied on to grapple with the corner post, container, and product as the corner post is inserted into the shipping container. Furthermore, as there is no structure to aid the shipping clerk in holding the corner post in its operable configuration, corner post designs are typically very simplistic with generally only two panels of the corner post overlapping. Of course, this minimizes the amount of corrugated that can be utilized in the corner post which minimizes the amount of compressive strength that the corner post can add to the shipping container. For corner posts having a more complex or intricate design, generally greater labor and attention need be devoted to utilize these designs in packaging. Therefore, a greater expense is experienced through additional labor costs in completing the packaging of any one item.

To solve these and other problems of the prior art, the inventors herein have succeeded in developing a corner post which may be simply and cheaply manufactured, but which provides a somewhat greater compressive strength due to the increased amount of corrugated panels utilized in the design and which also provides decreased time to convert the corner post from its flat orientation to its operable configuration. Furthermore, the corner post has two panels which are pre-glued to help the shipping clerk both in reconfiguring the corner post from its flat to its operable orientation and also to help the shipping clerk maintain the corner post in its operable configuration as it is inserted within the container itself. Thus, a great savings in labor is experienced with the corner post of the present invention over that of the prior art, while providing greater compressive strength than was previously attainable.

In essence, the corner post design of the present invention is comprised of a single sheet of corrugated which is folded over into two portions, both portions being substantially the same width. A series of score lines or slit scores are utilized to divide the corner post into a series of panels, much as in the prior art designs. However, significantly, the two end or outermost panels of the upper and lower portions are joined together across their face, such as by gluing or the like. Thus, the corner post is fixed in a folded over orientation, at least in its flat configuration. To reconfigure the corner post from its flat orientation (as utilized for shipping and handling in bulk) to its operable configuration, a shipping clerk need only apply pressure at the edges of the corner post flat which causes the upper and lower portions to separate and then to collapse inwardly as the necessary right angle is formed between the two largest panels. The inner panels then self-align virtually automatically due to the arrangement of the score lines. The corner post has a greater tendency to remain in the operable configuration than the roll-up design of the prior art and, certainly, there is no tendency for the corner post to unroll as the end panels have been permanently glued together. It should be noted that although this process has been described by a number of distinct steps, in a typical conversion from the flat configuration to the operable configuration, a shipping clerk soon becomes skilled in "snapping" these corner posts into shape such that it is virtually a one-step, instantaneous process which rather markedly reduces the amount of time required for the shipping clerk to ready a corner post for insertion into the shipping container. This results in a significant labor savings, and hence decreased cost to package an item for shipment.

Although some of the principal advantages and features of the present invention have been described above, a greater understanding of the invention may be attained by referring to the drawings and description of the preferred embodiment which follows.

DETAILED DESCRIPTION OF THE PREFERRED EMBODIMENT

Figure 1:
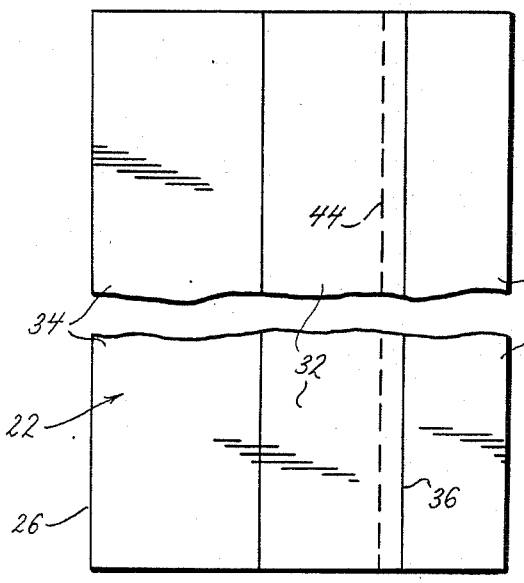
FIG. 1 is a plan view of the corner post in its flattened configuration.
Figure 2:
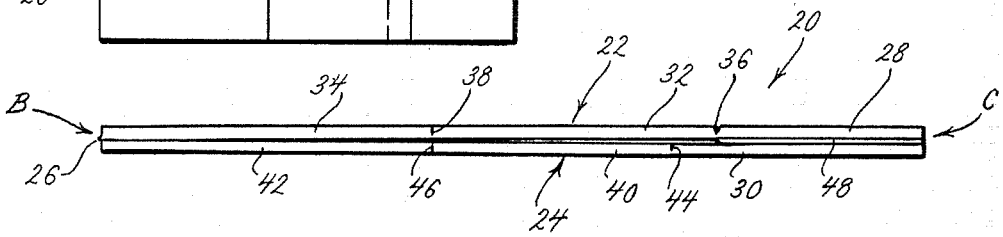
FIG. 2 is a side view of the corner post in a flattened configuration.

The corner post 20 is depicted in its flat configuration in FIGS. 1 and 2, and as shown therein generally includes an upper portion 22 and a lower portion 24. These portions 22, 24 are defined by a regular or slit score line 26 which permits a single piece of corrugated paperboard to be folded over in substantially equal portions. Thus, an outer panel 28 of upper portion 22 overlies an outer panel 30 of lower portion 24. The upper portion 22 has three panels: outer panel 28, middle panel 32, and inner panel 34, these panels being defined by a regular score line 36 and an outside slit score line 38. Lower panel 24 is also comprised of three panels: outer panel panel 30, middle panel 40, and inner panel 42. These panels are defined by inside slit score line 44 and outside slit score line 46.

The upper portion 22 and lower portion 24 have their end panels 28, 30 joined by a layer of glue 48 substantially across their faces such that the single sheet of corrugated used to make corner post 20 is permanently affixed in its "folded over" orientation.

Figure 3:
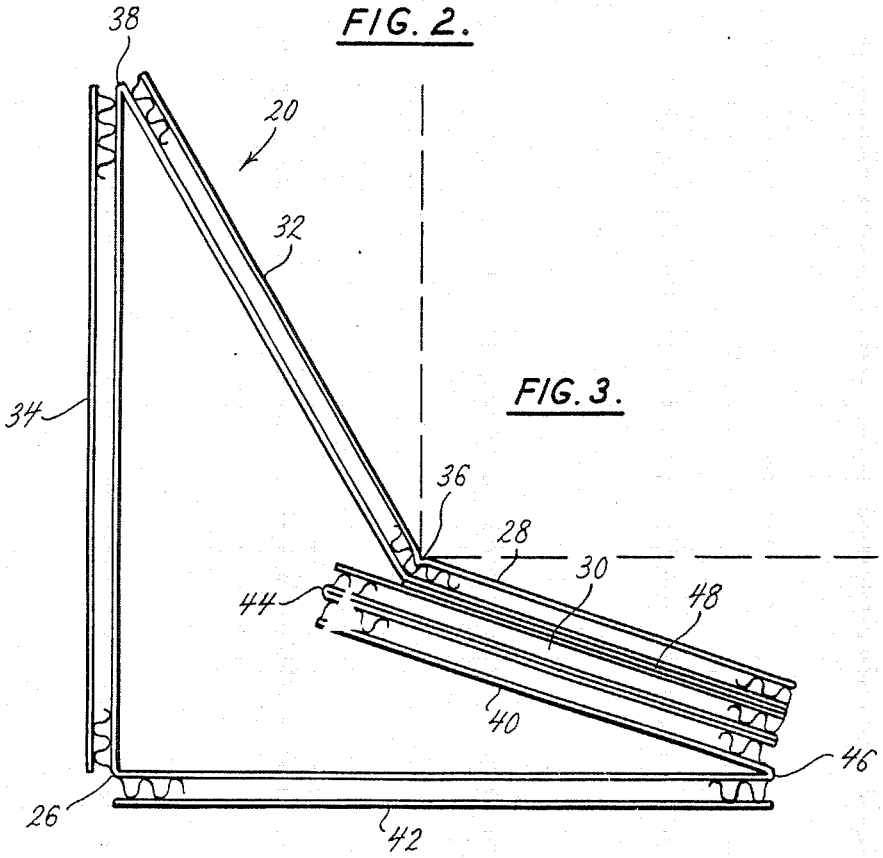
FIG. 3 is a top view of the corner post in its operable configuration.

To reorient the corner post 20 from its flat configuration as shown in FIGS. 1 and 2 into its operable configuration as shown in FIG. 3, a shipping clerk need only apply pressure at edges B and C which causes the upper and lower portions to fold about their score lines. As there is an inside slit score line 44, that score line causes panel 40 to fold under panel 30 such that there are three panels of corrugated which align as shown in FIG. 3. As the corner post is glued together, the compression action at points B and C can, with a minimal amount of practice, cause the corner post to "snap" into the operable configuration as shown in FIG. 3. Furthermore, because of pre-glued panels, there is a reduced tendency for the corner post to unwind or return to its flattened configuration over that experienced in prior art designs. Furthermore, the close alignment of three corrugated panels helps to increase the compressive strength over prior art designs in which there are no pre-glued panels.

The corner post may then be inserted between an item to be boxed and shipped and the sidewall of the container and, as shown in dotted lines in FIG. 3, positions the item such that one of its surfaces is closer to the sidewall of the container than its adjacent surface is to its associated side wall. This is because the joining members 32 and 28, 32, 40 are asymmetrical about a line bisecting the angle between the first and second panel members 34, 42 when the corner post is in its operable configuration. As shown in FIG. 3, the corner post substantially comprises a polygon having its sides joined at each of its corners in this operable configuration. This polygon essentially comprises a pair of members which form a perpendicular or right angle for close fitting into one of the corners of the box, the ends of those members being joined by a plurality of joining members which are foladably connected to each other to substantially form an obtuse angle with the foldable connection contacting the corner of the item to be boxed such that there is a space between each adjacent sidewall and the boxed item. Thus, a single corner post design can be used to adjust the position of the item within the box to provide additional clearance for fittings or the like along one edge of the container.

There are various changes and modifications which may be made to the invention as would be apparent to those skilled in the art. However, these changes or modifications are included in the teaching of the disclosure, and it is intended that the invention be limited only by the scope of the claims appended hereto.

What is claimed is:

1. A corner post for insertion into each of the corners of a shipping container to hold an item contained therein in a spaced apart relationship from both adjacent sidewalls of said container as said container is shipped, said corner post being comprised of a single, continuous piece of substantially rectangular corrugated paperboard, said corner post having means defining a plurality of panels therein, at least two of said panels being joined over a substantial portion of their faces, said corner post having a first portion folded over a second portion in a first configuration so that said corner post is substantially flat in the first configuration, and wherein said corner post may be quickly and easily realigned by folding into a second, operable, configuration, said second configuration being characterized by space between said first and second portions wherein the first portion forms a substantially perpendicular angle and the second portion forms a substantially obtuse angle, said space being oriented to provide a cushioning effect between the item and both adjacent sidewalls.

2. The device of claim 1 wherein said panel defining means comprises either a score or slit score in said corrugated paperboard.

3. the device of claim 1 wherein the outside panels of each portion comprise the joined panels.

4. The device of claim 1 wherein each portion is substantially the same width.

5. The device of claim 1 wherein said second configuration at least one other panel is adjacent said joined panels.

6. The device of claim 1 wherein said corner post has means to hold the item to be boxed further from one sidewall of the container than from the adjacent sidewall of the container.

7. The device of claim 2 wherein said scores or slit scores are not all on the same side of the single piece of corrugated paperboard.

8. A convertible corrugated, one piece, corner post for insertion into a shipping container, said corner post being adapted to contact an item to be boxed into said container and retain it in a spaced relationship from both adjacent sidewalls of said container as said container is shipped, said corner post having a first configuration characterized as being substantially flat to facilitate its bulk handling and shipping, and a second configuration characterized as having first and second members substantially perpendicular to each other for close fitting into the corners of the container and joining members which extend between said first and second members such that a joining member foldably extends from each of said first and second members at an acute angle and such that said joining members are foldably connected to each other to substantially form an obtuse angle, said joining members being spaced apart from the first and second members at the foldable connection for contacting the item to be boxed into said container and provide cushioned support therefor from both adjacent sidewalls, wherein said corner post has means to quickly and easily be re-configured from said first configuration to said second configuration, all of said first, second, and joining members being joined together.

9. The device of claim 8 wherein said reconfiguration means comprises a plurality of slit or score lines separating the members of said corner post.

10. The device of claim 9 wherein said joining members comprise third and fourth members, at least one of said third or fourth members being comprised of a plurality of panels of corrugated paperboard.

11. The device of claim 10 wherein at least two of said plurality of panels are glued together.

12. The device of claim 11 wherein at least one of said plurality of panels is not glued to any other of said plurality of panels.

13. The device of claim 8 wherein said joining members are asymmetrical about a line bisecting the angle between said first and second members when said corner post is in its second configuration.

14. The device of claim 8 wherein said joining members are configured to separate the item to be boxed further from one sidewall of the container than from the adjacent sidewall of the container.

15. The device of claim 8 wherein said corner post substantially comprises a polygon in its second configuration, said polygon having its sides joined at each of its corners.

* * * * *